US008186392B2

(12) United States Patent
Gustafsson

(10) Patent No.: US 8,186,392 B2
(45) Date of Patent: May 29, 2012

(54) DEVICE FOR FILLING OF A CONTAINER OF COLLAPSIBLE TYPE

(75) Inventor: Per Gustafsson, Bjärred (SE)

(73) Assignee: Ecolean Research & Development A/S, Copenhagen (DK)

( * ) Notice: Subject to any disclaimer, the term of this patent is extended or adjusted under 35 U.S.C. 154(b) by 999 days.

(21) Appl. No.: 12/160,013

(22) PCT Filed: Feb. 1, 2007

(86) PCT No.: PCT/SE2007/000093
§ 371 (c)(1),
(2), (4) Date: Jul. 3, 2008

(87) PCT Pub. No.: WO2007/091943
PCT Pub. Date: Aug. 16, 2007

(65) Prior Publication Data

US 2009/0000692 A1 Jan. 1, 2009

(30) Foreign Application Priority Data

Feb. 10, 2006 (SE) ..... 0600289

(51) Int. Cl.
*B65B 3/04* (2006.01)
*B65B 1/04* (2006.01)

(52) U.S. Cl. ..... 141/114; 141/10; 141/315; 53/284.7; 53/469

(58) Field of Classification Search ..... 141/10, 141/114, 313–317; 53/284.7, 469
See application file for complete search history.

(56) References Cited

U.S. PATENT DOCUMENTS

| | | | | |
|---|---|---|---|---|
| 2,703,671 | A | 3/1955 | Kindseth | |
| 2,715,004 | A | 8/1955 | Fox | |
| 2,727,669 | A | 12/1955 | Sackett | |
| 3,785,410 | A * | 1/1974 | Carter | 141/10 |
| 4,054,018 | A * | 10/1977 | Neukom | 141/257 |
| 5,788,620 | A * | 8/1998 | Aeschbach | 493/212 |

FOREIGN PATENT DOCUMENTS

| | | | |
|---|---|---|---|
| FR | 1251336 | A | 12/1960 |
| WO | 9941155 | A1 | 8/1999 |
| WO | 03026969 | A1 | 4/2003 |

* cited by examiner

*Primary Examiner* — Gregory Huson
*Assistant Examiner* — Nicolas A Arnett
(74) *Attorney, Agent, or Firm* — Volpe and Koenig, P.C.

(57) ABSTRACT

A device for filling a container with a liquid product, the container having a compartment which communicates with the surroundings via a filling duct. The device comprising a filling tube with an end portion, which is insertable into the filling duct. The device includes a clamp which is adapted to grasp the end portion and the filling duct when said end portion is inserted into said filling duct to provide a seal. The clamp has gripping surfaces which are arranged to cooperate with the end portion when the clamp grasping the filling duct. Each gripping surface has opposite edge portions, a bead being arranged in each edge portion. The end portion has a circumferential surface which is formed of two opposite partial surfaces which each comprise a convexly curved central portion and a concavely curved side portion arranged on each side of the central portion.

9 Claims, 5 Drawing Sheets

DEVICE FOR FILLING OF A CONTAINER OF COLLAPSIBLE TYPE

FIELD OF THE INVENTION

The present invention relates to a device for filling a container of a collapsible type with a liquid product, and more specifically such a device which comprises a filling tube with an end portion, which is insertable into a filling duct of the container to supply a product to the compartment of the container through said filling tube.

BACKGROUND ART

A variety of container types for packaging liquid products are currently available.

One type of container is collapsible and comprises two flexible side walls and a bottom wall, which walls are joined to each other along a connecting portion to form a compartment, whose volume is dependent on the relative position of the walls.

Before filling, this type of container can be in a flat and sealed state. As a result, it will be possible to sterilise the compartment of the container in connection with manufacture and, with maintained sterility, distribute the container to a filling plant, such as a dairy.

A container of the type described above is known from WO99/41155 which also discloses a device for filling a container.

Said device comprises a nozzle which is insertable into a filling duct of the container, which filling duct is opened by cutting or the like operation in connection with filling of the container.

During the actual filling process, said nozzle is thus inserted into the filling duct, after which a product valve is opened to supply the desired amount of product to the compartment of the container through said nozzle. The compartment will assume a volume which substantially corresponds to the volume of the supplied product. The filling process ensures that intrusion of air into the compartment is prevented or, in any case, reduced to a minimum.

The filling device disclosed in WO99/41155 comprises more specifically a nozzle which is made of an elastic material, such as silicone rubber. The nozzle has an end portion which tapers toward an outlet in the form of a gap in the lower end surface of the end portion.

The nozzle is self-closing, which means that the edge portions defining said gap engage each other in the absence of exterior forces.

During the filling process, the nozzle is, as mentioned above, inserted into the filling duct of the container, after which the product is supplied to the compartment through said nozzle. The product pressure will act to open the nozzle and at the same time to establish a seal between the nozzle and the walls of the filling duct so as to ensure that air does not enter the container.

Increasing requirements are placed on the efficiency of filling devices of the type described above and, thus, also on the speed at which the device allows filling of an individual container.

Faster filling can be provided with an increased product flow rate, which results in a higher product pressure. It has been found that an increased product pressure can in some cases result in product being pressed out of the compartment of the container between the nozzle and the walls of the filling duct. Obviously this results in difficulties in maintaining a hygienic environment in the filling device.

WO03/026969 discloses a device for filling a bag with a pulverulent or liquid material. The device comprises a boat-shaped adapter which is connected to a filling tube and a clamping means which is shaped complementarily to the adapter. For filling of the bag, the adapter is inserted into the opening of the bag, after which the clamping means grasps the adapter to provide a seal.

There is a need for a filling device which allows efficient and rational filling of collapsible type containers.

SUMMARY OF THE INVENTION

In view of that stated above, it is an object of the present invention to provide a device for filling containers of a collapsible type, which device allows fast filling under hygienic conditions.

To achieve this object, and also other objects that will be evident from the following description, there is suggested according to the present invention a device having the features defined in claim 1. Embodiments of the inventive device will be evident from claims 2-5 which are dependent on claim 1.

More specifically, according to the present invention there is suggested a device for filling a container of a collapsible type with a liquid product, said container having a compartment which is defined by flexible walls and whose volume is dependent on the relative position of the walls and which communicates with the surroundings via a filling duct of the container. The device comprises a filling tube with an end portion, which is insertable into said filling duct of the container for supplying a product to the compartment of the container through said filling tube. The device is characterised by a clamping means, which is adapted to grasp the end portion and the filling duct when said end portion is inserted into said filling duct to provide a seal between the end portion and the filling duct, which clamping means has gripping surfaces which are arranged to cooperate with the circumferential surface of the end portion in the state of the clamping means grasping said filling duct and said end portion to provide said seal between the end portion and the filling duct. Each gripping surface has opposite edge portions, a bead being arranged in each end portion. The end portion has a circumferential surface which is formed of two opposite partial surfaces which each comprise a convexly curved central portion and a concavely curved side portion arranged on each side of the central portion. The partial surfaces are arranged with the convexly curved central portions facing away from each other, the side portions of the opposite partial surfaces connecting to each other in a converging manner on the respective sides of the central portions, and each concavely curved side portion forming a recess in the neighbouring concavely curved central portion. As a result, a device is provided, which allows fast filling of a container under hygienic conditions. The clamping means is adapted to grasp the end portion of the filling tube when said end portion is inserted into the filling duct of the container, and will thus provide a seal which prevents the product from escaping from the container. The reliability of the seal is achieved by the shape of the end portion. The end portion has in fact a circumferential surface with convexly curved central portions facing away from each other and concavely converging side portions. The shape of the end portion makes it possible for the clamping means to apply a sealing clamping pressure along the entire circumference of the end portion. The concavely converging side portions also make it possible to prevent a gap from forming even if the clamping means should have deformations due to the manufacturing technique or due to wear. The grasping capability of the clamping means is achieved by said gripping surfaces which also allow replaceability, for example after wear and tear. By providing the gripping surfaces with beads, it will be possible to ensure that the gripping surfaces apply the required sealing pressure to the points where the concavely curved side portions of the end portion of the filling tube convergingly connect to each other on the respective sides of the central portions. By the concavely curved side portions forming recesses in the respective neighbouring central portions, easy manufacture of the end portion of the filling tube is allowed.

Each gripping surface can be elastic.

The clamping means of the device may comprise a pair of jaws, where the two jaws which are to be brought together each have one of said gripping surfaces.

The side portions on the respective sides of the central portions of the partial surfaces can converge at a point which is arranged in a parting line of said pair of jaws.

The clamping means may comprise two gripping surfaces, which are arranged to cooperate each with a partial surface of the circumferential surface of the end portion in the state of the clamping means grasping said filling duct and said end portion.

BRIEF DESCRIPTION OF THE DRAWINGS

Embodiments of the present invention will now be described by way of example and with reference to the accompanying drawings.

DESCRIPTION OF EMBODIMENTS

Figure 1:
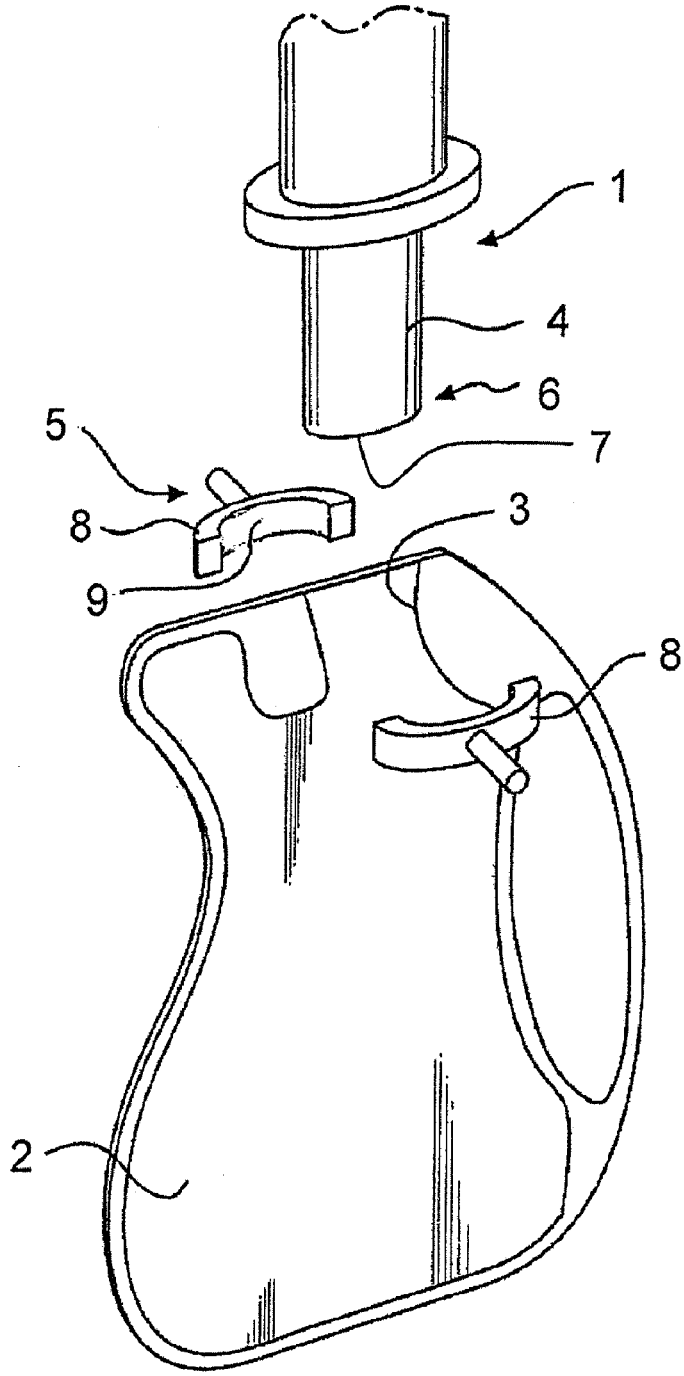
FIG. 1 is a schematic perspective view of an embodiment of an inventive device for filling a container of a collapsible type.

FIG. 1, to which reference is made, illustrates a device 1 for filling a container 2 of a collapsible type.

A container 1 of this type can, as shown in the figure, have two opposite side walls and a bottom wall (not shown), which walls are joined to each other along a connecting portion and define a compartment, whose volume is dependent on the relative position of the walls. A filling duct 3 of the container, which filling duct 3 can be defined by said side walls, makes its compartment communicate with the surroundings. In the unfilled state of the container, the filling duct 3 can be sealed, in which case the duct 3 is opened before filling. This makes it possible to easily ensure that containers 2 with sterile compartments are used in the inventive device 1.

The device 1 comprises as main components a filling tube 4 and a clamping means 5. The other components of the inventive device 1 have been omitted for increased clarity.

The filling tube 4 is connected to a source (not shown) of the product to be supplied to the container 1 and is terminated with an end portion 6. The end portion 6 has an outlet 7.

In the embodiment shown, the clamping means 5 comprises a pair of jaws 8, which are arranged to grasp the end portion 6 of the filling tube 4. Thus, the jaws 8 are to be brought together, the container 2 being positioned so that its opposite side walls are parallel to the parting line of the pair of jaws 8.

The end portion 6 of the filling tube 4 is made of a rigid material, such as stainless steel, and each jaw 8 has an elastic gripping surface 9.

Figure 2:
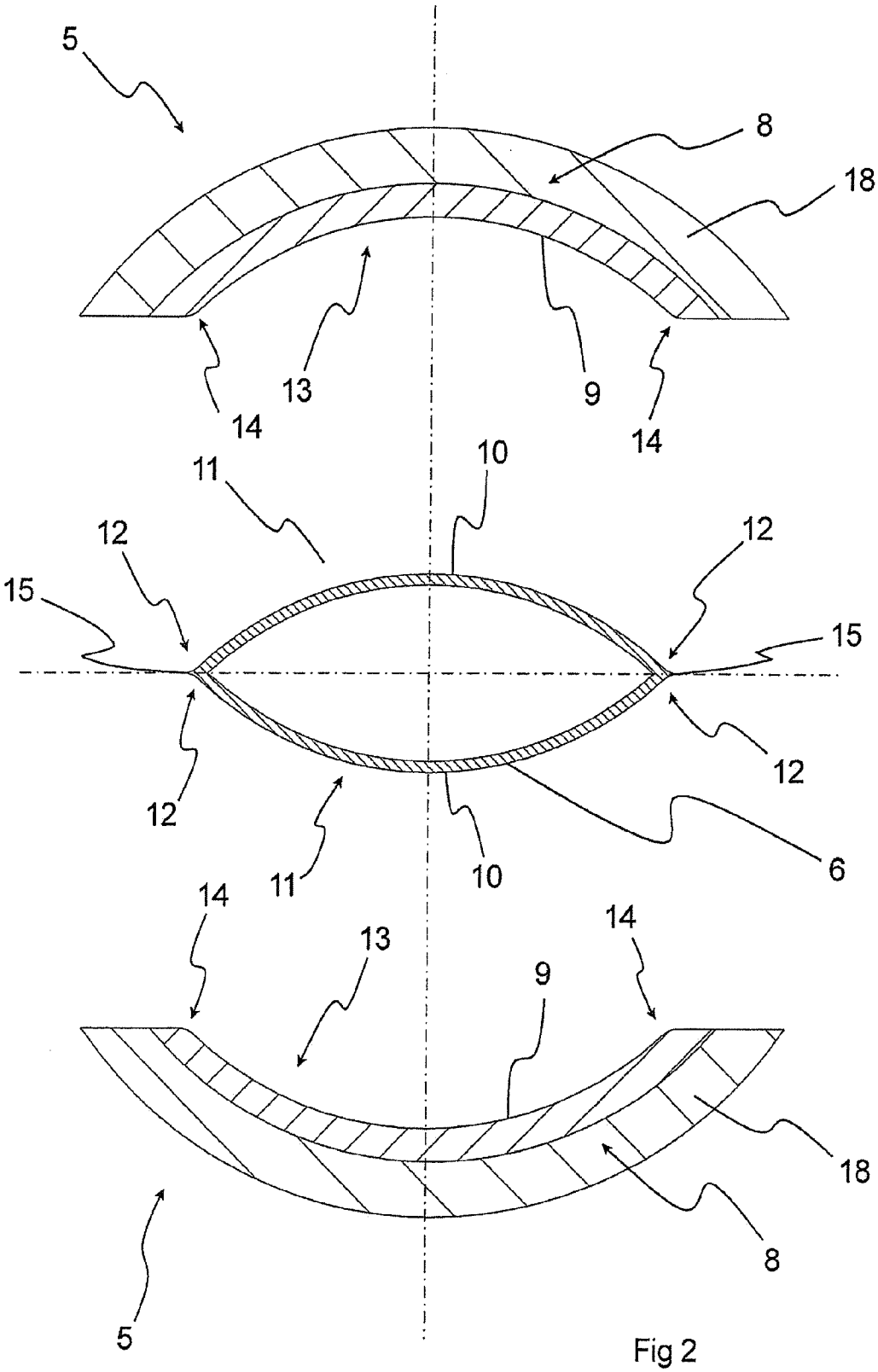
FIG. 2 is a schematic cross-sectional view along the line 2-2 in FIG. 1.

FIG. 2, to which reference is now made, is a schematic cross-section of the inventive device 1, which cross-section is taken transversely to the end portion 6, seen in the longitudinal direction of the filling tube 4. As is evident from the figure, the end portion 6 of the filling tube 4 has a circumferential surface which is formed of two opposite partial surfaces 10, which each have a convexly curved central portion 11 and a concavely curved side portion 12 arranged on each side of the central portion 11. The central portion 11 occupies the major part of each partial surface 10.

The two opposite partial surfaces 10 are arranged with the convexly curved central portions 11 facing away from each other and the side portions 12 of the partial surfaces 10 on the respective sides of the central portions 11 connect to each other in a converging manner.

The gripping surfaces 9 of each jaw 8 are designed complementarily to an associated partial surface 10 of the circumferential surface of the end portion 6. Thus, each gripping surface 9 has a concavely curved central portion 13, which is complementary to the convexly curved central portion 11 of the respective partial surfaces 10. Moreover each gripping surface 9 has two opposite and rounded edge portions 14. The rounded edge portions 14 are complementary to the concavely curved side portions 12 of each partial surface 10.

It will be appreciated that the gripping surfaces need not be designed complementarily to the partial surfaces of the circumferential surface. The important thing is that the gripping surfaces are applied to the filling duct of the container and cooperate with said partial surfaces when the clamping means grasps the filling duct and the end portion, inserted therein, of the filling tube for applying a sealing clamping pressure along the circumference of the circumferential surface.

Each gripping surface 9 of the respective jaws 8 is supported by a structure 18.

Beads (not shown) can be arranged in said end portions 14 to produce a required clamping pressure. By the gripping surface 9 being made of an elastic material, the beads will be compressed when bringing the jaws 8 together and thus act to provide a required seal at a point indicated at 15, where the concavely curved side portions 12 of the end portion 6 of the filling tube 4 connect to each other in a converging manner.

It will be appreciated that the entire end portion 6 need not necessarily have a circumferential surface of the shape described above. It is thus sufficient if the end portion 6 has an area with a circumferential surface of the shape described above, which area consequently is that part of the end portion 6 which the pair of jaws 8 is adapted to grasp.

For filling a container, the container 2 is, as shown in FIG. 1, by way of introduction positioned under the inventive device 1. The filling duct 3 of the container 2 has been opened by cutting or the like operation, whereby the compartment of the container 2 communicates with the surroundings via said filling duct 3.

The positioning of containers can be performed in various ways, for example using an arrangement of laterally movable gripping means, from which the containers are suspended (not shown).

Figure 3:
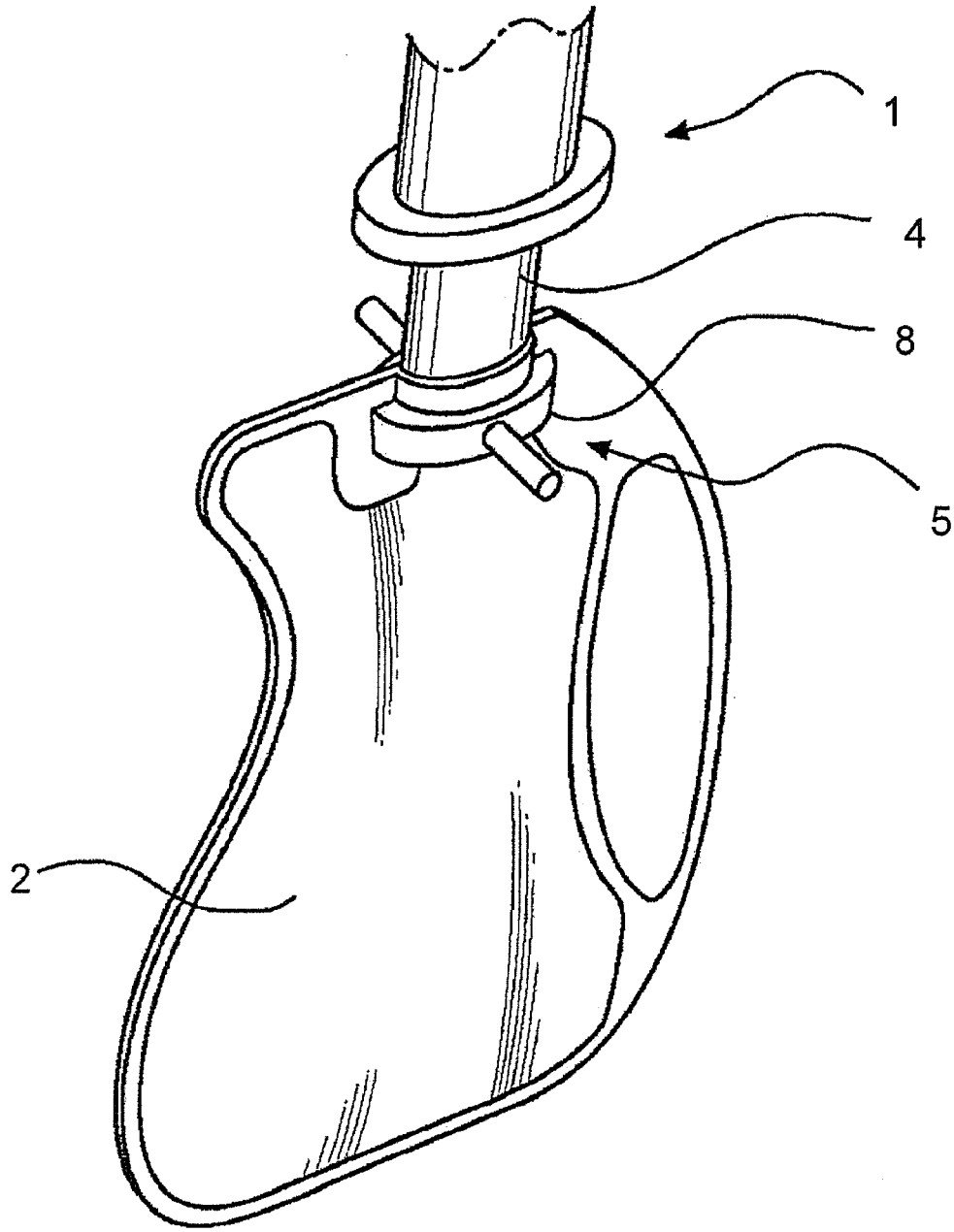
FIG. 3 is a schematic perspective view which illustrates the device in FIG. 1 while used for filling a container of a collapsible type.

Subsequently the end portion 6 of the filling tube 4 is inserted into the filling duct 3 of the container 2 and the clamping means 5 is activated so that its pair of jaws 8 grasps the end portion 6 and thus also the filling duct 3, which is illustrated in FIG. 3. Since the end portion 6 of the filling tube 4 is made of a rigid material while the gripping surfaces 9 of the pair of jaws 8 are elastic, a seal is provided between said filling duct 3 and the end portion 6, which does not risk damaging the side walls of the container 2 which define said filling duct 3. It will be appreciated that the structures 18 of the jaws 8 can be arranged to ensure that the gripping surfaces 9 act to generate a clamping pressure in the direction of bringing together the jaws 8 as they are brought together. This can be achieved, for example, by the gripping surfaces being allowed to protrude slightly from said structures 18 (not shown).

When the clamping means 5 has been activated so that its pair of jaws 8 grasps the filling duct 3 and the end portion 6 of the filling tube 4, the container 2 can be filled with contents in a suitable fashion. This can be performed, for example, by opening a filler valve (not shown) which can be positioned in the outlet 7 of the end portion 6. Of course, the filler valve can also be arranged in a different position in the filling tube 4 or in a product line which is connected to the filling tube 4.

The end portion 6 can have a tapered shape to facilitate insertion of the same into the filling duct 3 of the container 2.

By opening said filler valve, the product will flow out of the filling tube 4 and on into the compartment of the container 2. During the filling process, the compartment of the container 2 will be expanded in response to the entering product like a balloon that is being inflated. The seal provided by the clamping means 5 ensures that the product cannot be pressed out of the container 2 between the filling duct 3 and the end portion 6 of the filling tube 4.

The design of the end portion 6 helps to ensure that the seal is reliable. The shape of the circumferential surface of the end portion 6 allows the clamping means 5 to act to apply a clamping pressure along the entire circumference of the circumferential surface. More specifically, the converging side portions 12 of the partial surfaces 10 of the end portion 6 will act to prevent a gap forming as the clamping means 5 grasps the end portion 6, which is more distinctly shown in FIGS. 4 and 5.

Figure 4:
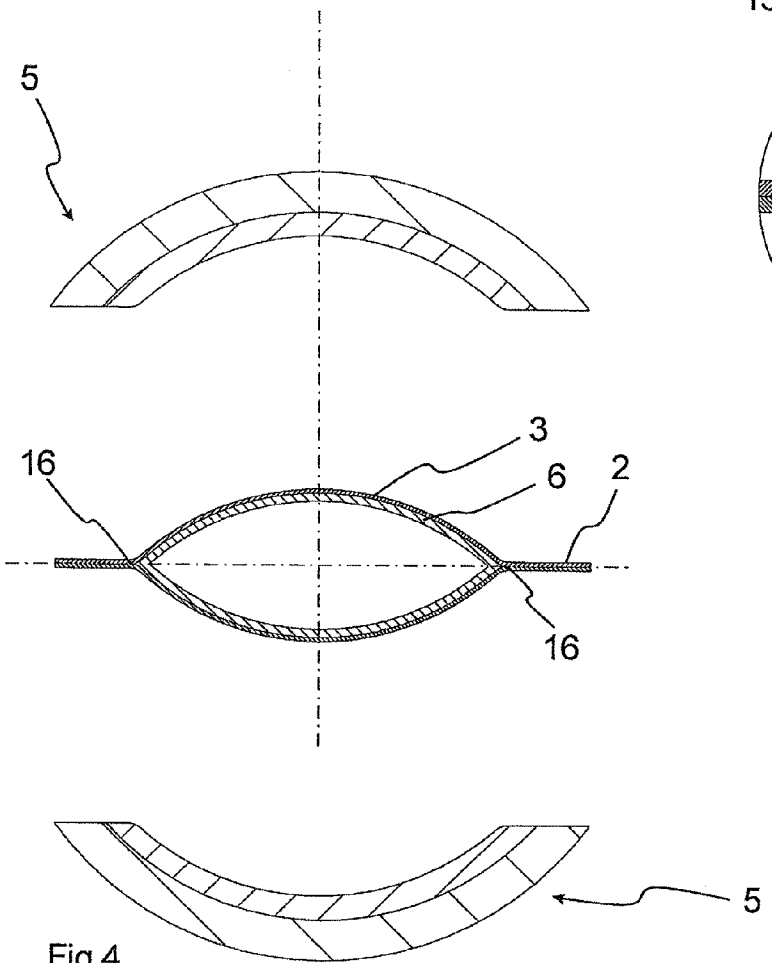
FIG. 4 is a schematic cross-sectional view transversely to the filling tube of the device shown in FIG. 1 before a clamping means of the device has been activated.

FIG. 4 is a schematic cross-section taken transversely to the filling tube 4 when its end portion 6 has been inserted into the filling duct 3 of the container 2, but before the clamping means 5 has been activated to grasp the end portion 6 and said filling duct 3.

As mentioned above, the end portion 6 of the filling tube 4 has a circumferential surface which is mainly formed of two convexly curved central portions 11 facing away from each other. This shape is optimal to provide as large a filling area as possible given minimal bringing together of two opposite lateral edges 16 of the filling duct 3. The minor bringing-together of said lateral edges 16 ensures control over the containers 1 during the filling process.

Figure 5:
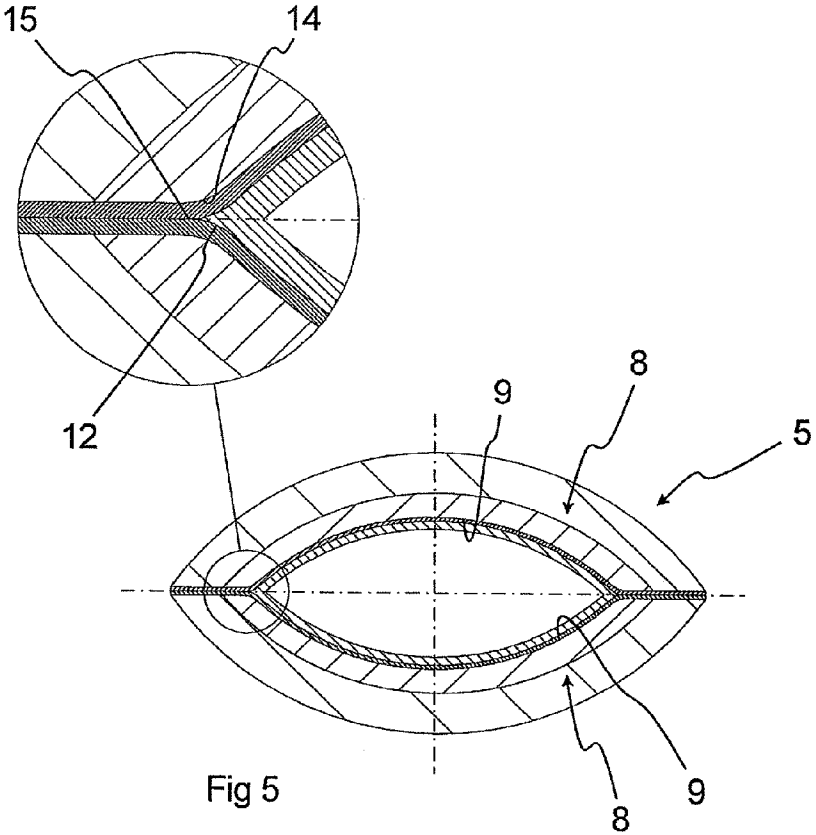
FIG. 5 is a schematic cross-sectional view transversely to the filling tube of the device shown in FIG. 1 when the clamping means has been activated.

In FIG. 5, said clamping means 5 has been activated, and thus the gripping surfaces 9 of the pair of jaws 8 have been moved into engagement with the partial surfaces 10 of the circumferential surface of the end portion 6 with the filling duct 3 of the container 2 arranged between them.

The above-mentioned forming of a gap tends to arise at a point, indicated at 15, where the concavely curved side portions 12 connect to each other in a converging manner. Due to the side portions 12 being concavely curved, it is ensured that the gripping surfaces 9, and more specifically their rounded edge portions 14, can be sealingly applied to the side portions 12 of the partial surfaces 10, thereby substantially eliminating the forming of a gap. This is more distinctly to be seen in the broken-away enlarged view in FIG. 5.

The end portion 6 of the filling tube 4 being arranged to cooperate with a clamping means 5, whose gripping surfaces 9 have rounded edge portions 14, results in elimination or, in any case, reduction of the problems due to leakage that may arise because of wear or for reasons of manufacture.

It will be appreciated that the present invention is not limited to the shown embodiment.

Figure 6:
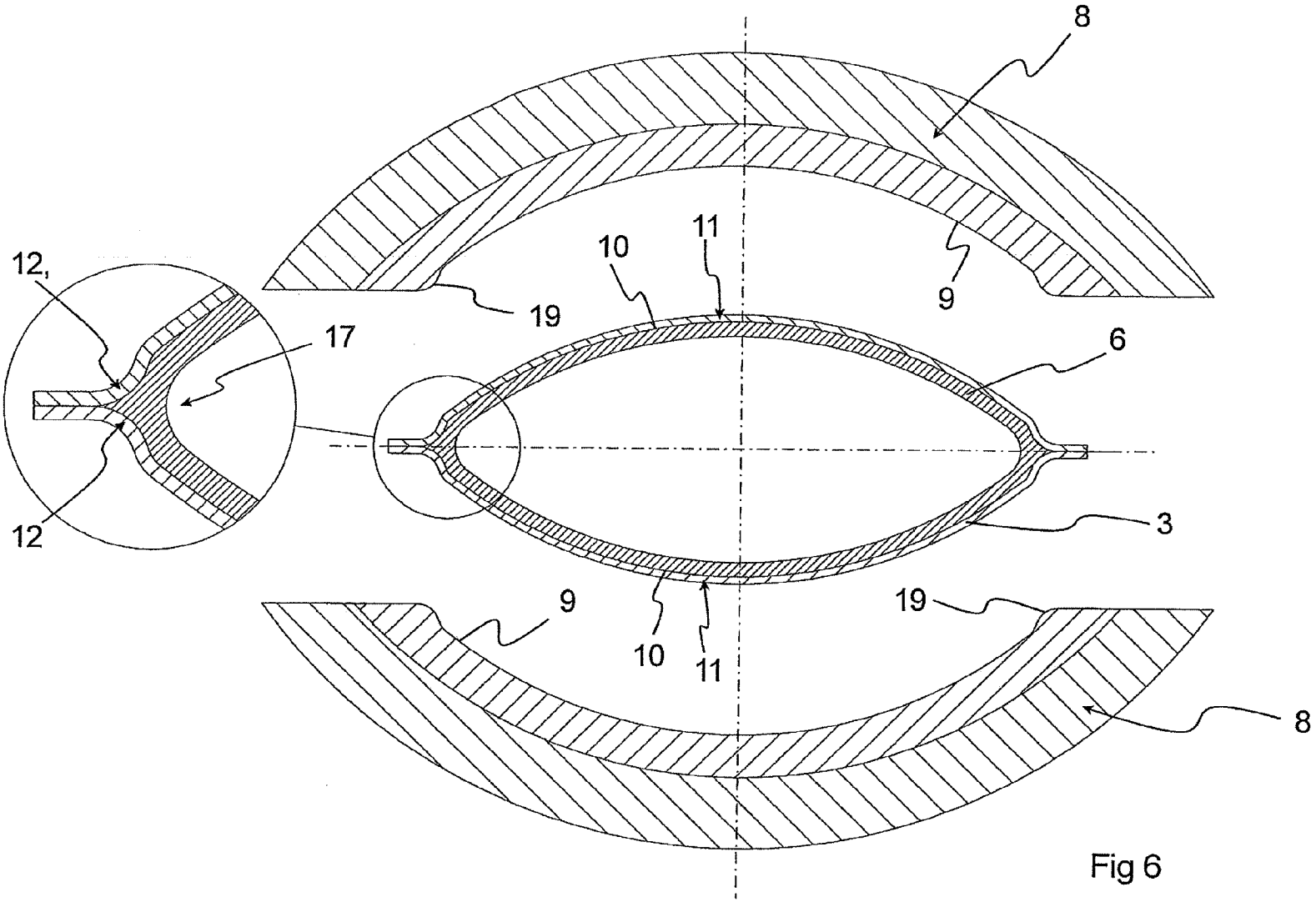
FIG. 6 is a schematic cross-sectional view of a second embodiment of the present invention.

For instance, it is possible to design the end portion 6 differently. FIG. 6, to which reference is now made, illustrates the end portion 6 of the filling tube 4 inserted into a filling duct 3 of a container 2 with surrounding jaws 8 in a not-joined state. Also in this embodiment, the end portion 6 of the filling tube 4 has a circumferential surface which is formed of two opposite partial surfaces 10, which each have a convexly curved central portion 11 and a concavely curved side portion 12 arranged on each side of the central portion 11. The central portion 11 occupies the major part of each partial surface 10. The two opposite partial surfaces 10 are arranged with the convexly curved central portions 11 facing away from each other, and the side portions 12 of the partial surfaces 10 on each side of the central portions 11 connect to each other in a converging manner. What differs the embodiment from that shown in FIG. 2 is that the side portions 12 of each partial surface 10 form recesses in the associated central surface 11. To shape the circumferential surface of the end portion 6, it is thus possible to initially give the circumferential surface of the end portion 6 the shape of two circular arcs facing away from each other. In a subsequent step, the side portions 12 are formed, for example, by an electrical discharge milling or grinding operation. It should also be noted that the end portion 6 has an inner circumferential surface with rounded corners 17, which promotes maintenance of a hygienic filling environment.

Like in the previously described embodiment, the gripping surface 9 of each jaw 8 is designed complementarily to the associated partial surface 10 of the circumferential surface of the end portion 6. As shown in the figure, a bead 19 is arranged adjacent the respective end portions 14 of each jaw 8. Each bead can be designed complementarily to the corresponding side portion 12 of the end portion 6 of the filling tube 4. Alternatively, each bead 19 can be slightly overdimensioned to ensure the necessary sealing force.

To prevent the product from being deposited on the walls of the filling duct 3 as the end portion 6 of the filling tube 4 is pulled out, it is further possible to dimension this in such a manner relative to the filling duct 3 that the end portion 6 can be pulled out without contact with the walls of the filling duct 3.

Consequently, several modifications and variations are conceivable, and therefore the present invention is exclusively defined by the appended claims.

The invention claimed is:

1. A device for filling a container of a collapsible type with a liquid product, said container having a compartment which is defined by flexible walls and whose volume is dependent on the relative position of the walls and which communicates with the surroundings via a filling duct of the container, said device comprising a filling tube with an end portion, which is insertable into said filling duct of the container for supplying a product to the compartment of the container through said filling tube;

a clamp, which is adapted to grasp the end portion and the filling duct when said end portion is inserted into said filling duct to provide a seal between the end portion and the filling duct, the clamp having gripping surfaces which are arranged to cooperate with the circumferential surface of the end portion in the state of the clamp grasping said filling duct and said end portion to provide said seal between the end portion and the filling duct, each gripping surface having opposite edge portions, a bead being arranged in each edge portion, which end portion has a circumferential surface which is formed of two opposite partial surfaces which each comprise a convexly curved central portion and a concavely curved side portion arranged on each side of the central portion, the partial surfaces being arranged with the convexly curved central portions facing away from each other, the side portions of the opposite partial surfaces on the respective sides of the central portions connecting to each other in a converging manner, and each concavely curved side portion forming a recess in the neighbouring convexly curved central portion.

2. A device as claimed in claim 1, in which each gripping surface is elastic.

3. A device as claimed in claim 2, in which said clamp comprises two jaws which are to be brought together, each jaw having one of said gripping surfaces.

4. A device as claimed in claim 2, in which the gripping surfaces of the clamp are arranged to cooperate each with a partial surface of the circumferential surface of the end portion in the state of the clamp gripping said filling duct and said end portion.

5. A device as claimed in claim 1, in which said clamp comprises two jaws which are to be brought together, each jaw having one of said gripping surfaces.

6. A device as claimed in claim 5, in which the side portions on the respective sides of the central portions of the partial surfaces converge at a point which is arranged in a parting line of said pair of jaws.

7. A device as claimed in claim 6, in which the gripping surfaces of the clamp are arranged to cooperate each with a partial surface of the circumferential surface of the end portion in the state of the clamp gripping said filling duct and said end portion.

8. A device as claimed in claim 5, in which the gripping surfaces of the clamp are arranged to cooperate each with a partial surface of the circumferential surface of the end portion in the state of the clamp gripping said filling duct and said end portion.

9. A device as claimed in claim 1, in which the gripping surfaces of the clamp are arranged to cooperate each with a partial surface of the circumferential surface of the end portion in the state of the clamp gripping said filling duct and said end portion.

* * * * *